US012680186B2

(12) United States Patent
Tomita

(10) Patent No.: US 12,680,186 B2
(45) Date of Patent: Jul. 14, 2026

(54) APPARATUS FOR PLATING AND METHOD OF MANUFACTURING APPARATUS FOR PLATING

(71) Applicant: EBARA CORPORATION, Tokyo (JP)

(72) Inventor: Masaki Tomita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 733 days.

(21) Appl. No.: 18/020,249

(22) PCT Filed: Nov. 5, 2021

(86) PCT No.: PCT/JP2021/040789
§ 371 (c)(1),
(2) Date: Feb. 7, 2023

(87) PCT Pub. No.: WO2023/079684
PCT Pub. Date: May 11, 2023

(65) Prior Publication Data

US 2024/0254649 A1 Aug. 1, 2024

(51) Int. Cl.
*C25D 17/02* (2006.01)
*C25D 5/02* (2006.01)

(52) U.S. Cl.
CPC ..... *C25D 17/02* (2013.01); *C25D 5/022* (2013.01)

(58) Field of Classification Search
None
See application file for complete search history.

(56) References Cited

U.S. PATENT DOCUMENTS

| | | | | |
|---|---|---|---|---|
| 6,660,139 | B1 | 12/2003 | Sendai et al. | |
| 7,351,314 | B2 | 4/2008 | Klocke et al. | |
| 10,577,714 | B2 | 3/2020 | Mukaiyama et al. | |
| 2014/0231245 | A1* | 8/2014 | Sandmann | C25D 17/001 204/230.3 |
| 2016/0145760 | A1* | 5/2016 | Fujikata | C25D 17/10 205/128 |
| 2017/0051423 | A1 | 2/2017 | Van Valkenburg et al. | |
| 2019/0093250 | A1 | 3/2019 | Yamasaki et al. | |
| 2020/0270760 | A1 | 8/2020 | Nakagawa et al. | |
| 2023/0167574 | A1 | 6/2023 | Hiwatashi et al. | |

(Continued)

FOREIGN PATENT DOCUMENTS

| | | | | |
|---|---|---|---|---|
| CN | 108474132 A | | 8/2018 | |
| CN | 111140890 A | | 5/2020 | |
| CN | 112853445 A | * | 5/2021 | C25D 17/001 |

(Continued)

*Primary Examiner* — Louis J Rufo
(74) *Attorney, Agent, or Firm* — BakerHostetler

(57) ABSTRACT

One object of the present disclosure is to facilitate maintenance of components placed in a lower portion of a face down-type apparatus for plating. There is provided an apparatus for plating, comprising: a plating tank configured to store a plating solution therein; a substrate holder configured to hold a substrate in such a state that a plating surface of the substrate faces down; and a drawer unit mounted to the plating tank to be freely drawable in a horizontal direction and provided with an anode that is placed to be opposed to the substrate in the plating tank and with a variable anode mask that includes an opening which the anode is exposed from and that is configured to adjust an opening size of the opening.

13 Claims, 10 Drawing Sheets

(56) References Cited

U.S. PATENT DOCUMENTS

| | | | |
|---|---|---|---|
| 2024/0254649 | A1 | 8/2024 | Tomita |
| 2025/0137162 | A1 | 5/2025 | Takahashi |

FOREIGN PATENT DOCUMENTS

| | | | |
|---|---|---|---|
| CN | 114867892 | A | 8/2022 |
| JP | 2003-027290 | A | 1/2003 |
| JP | 2004-250776 | A | 9/2004 |
| JP | 2006-241599 | A | 9/2006 |
| JP | 2013-053372 | A | 3/2013 |
| JP | 5335013 | B2 | 11/2013 |
| JP | 2014-118634 | A | 6/2014 |
| JP | 2019-056164 | A | 4/2019 |
| JP | 6937974 | B1 | 9/2021 |
| KR | 10-2283855 | B1 | 8/2021 |
| WO | WO 2022/190243 | A1 | 9/2022 |
| WO | WO 2023/079684 | A1 | 5/2023 |
| WO | WO 2023/188371 | A1 | 10/2023 |
| WO | PCT/JP2024/008682 | | 3/2024 |

* cited by examiner

APPARATUS FOR PLATING AND METHOD OF MANUFACTURING APPARATUS FOR PLATING

CROSS-REFERENCE TO RELATED APPLICATIONS

This application is a U.S. national phase application of International Patent Application No. PCT/JP2021/040789 filed Nov. 5, 2021, which is incorporated by reference in its entirety for any and all purposes.

TECHNICAL FIELD

The present disclosure relates to an apparatus for plating and a method of manufacturing the apparatus for plating.

BACKGROUND ART

A face down-type or cup-type plating apparatus as described in Japanese Unexamined Patent Publication No. 2006-241599 (PTL 1) and Description of U.S. Pat. No. 7,351,314 (PTL 2) has been known as a plating apparatus configured to plate a substrate. Such a plating apparatus includes a plating tank configured to store a plating solution therein and provided with an anode placed therein; and a substrate holder (also called a plating head) placed above the anode and configured to hold a substrate as a cathode.

In the construction of this face down-type plating apparatus, the anode is placed in a lower most portion of the plating tank. There is accordingly a need to remove all the components above the anode in the operations for maintenance, such as replacement of the anode. This series of operations have problems including the low workability, the time-consuming operation, and the low operating rate of the plating apparatus. Japanese Unexamined Patent Publication No. 2006-241599 (PTL 1) discloses a configuration that an anode is placed in an anode holder attached to a plating tank in a freely drawable manner. Description of U.S. Pat. No. 7,351,314 (PTL 2) discloses a configuration that a plating tank is divided into individual units, i.e., a processing unit, a barrier unit, and an electrode unit, and that an anode is placed in the electrode unit that is a lower most portion.

CITATION LIST

Patent Literatures

PTL 1: Japanese Unexamined Patent Publication No. 2006-241599

PTL 2: Description of U.S. Pat. No. 7,351,314

SUMMARY OF INVENTION

Technical Problem

In the face down-type plating apparatus, for the purpose of, for example, preventing a terminal effect that plating an outer peripheral portion of a substrate is thicker than plating a center portion of the substrate due to an electric resistance of a seed layer on the substrate, it has been examined to place a variable anode mask that is configured to adjust the opening size, on a front face of the anode and to regulate an electric field from the anode toward the substrate. It is preferable to place this variable anode mask in the vicinity of the anode, in order to regulate the electric field from the anode toward the substrate with high efficiency. Like the anode, the variable anode mask is thus placed in a lowermost portion of the plating tank. Accordingly the variable anode mask has a similar problem relating to maintenance, to that of the anode.

By taking into account the foregoing, one object of the present disclosure is to facilitate maintenance of components placed in a lower portion of a face down-type apparatus for plating.

Solution to Problem

According to one aspect of the present disclosure, there is provided an apparatus for plating, comprising: a plating tank configured to store a plating solution therein; a substrate holder configured to hold a substrate in such a state that a plating surface of the substrate faces down; and a drawer unit mounted to the plating tank to be freely drawable in a horizontal direction and provided with an anode that is placed to be opposed to the substrate in the plating tank and with a variable anode mask that includes an opening which the anode is exposed from and that is configured to adjust an opening size of the opening.

DESCRIPTION OF EMBODIMENTS

Figure 1:
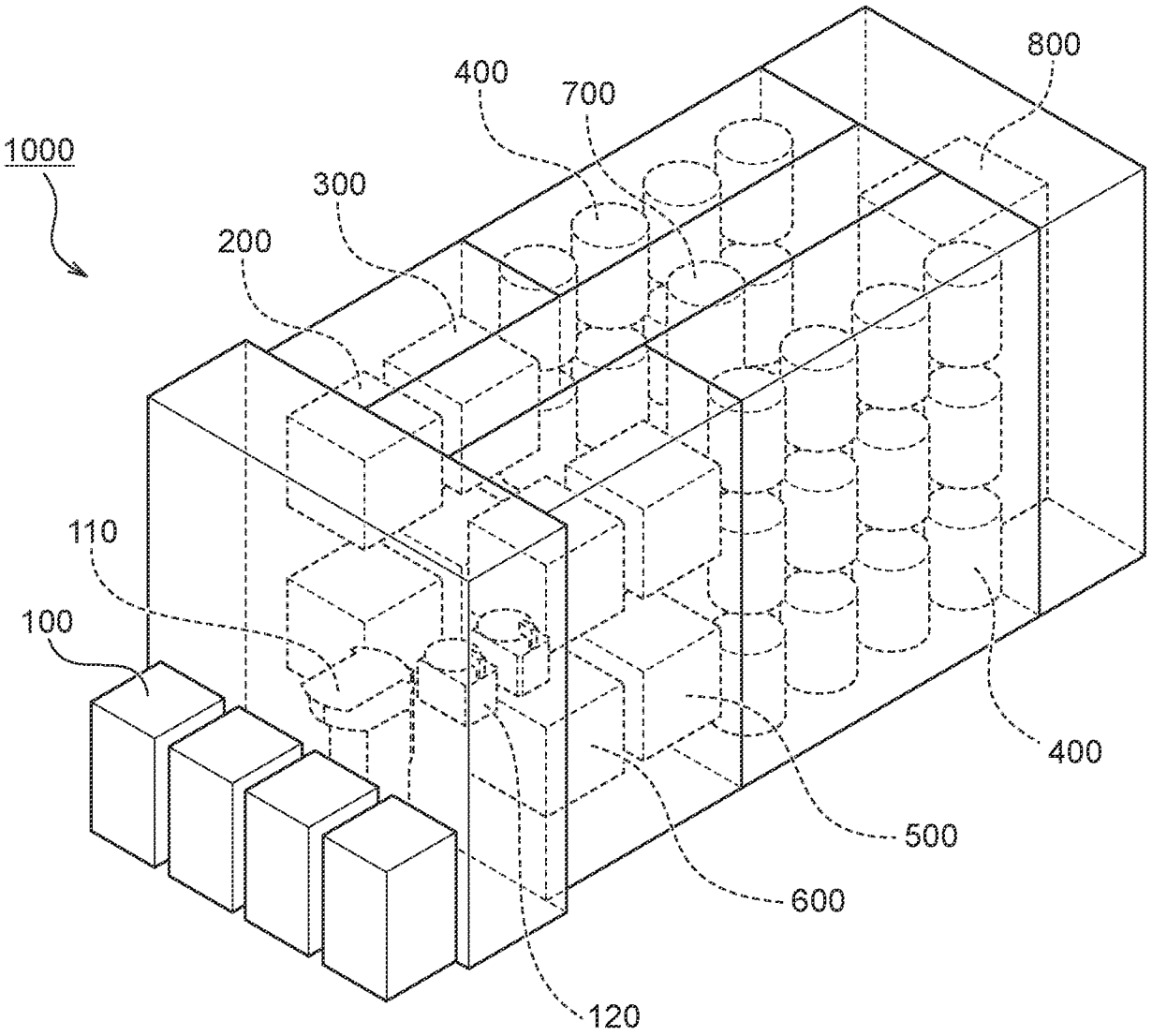
FIG. 1 is a perspective view illustrating the overall configuration of a plating apparatus according to one embodiment.

The following describes a plating apparatus 1000 according to one embodiment of the present disclosure with reference to drawings. The drawings are schematically illustrated, in order to facilitate understanding the features of substances. The ratio of dimensions of respective components and the like in the drawings may not be equal to those in the actual state. Cartesian coordinates X-Y-Z are illustrated in some of the drawings for the purpose of reference. In the Cartesian coordinates, a Z direction corresponds to an upward direction, and a −Z direction corresponds to a downward direction (direction where the gravity acts).

Figure 2:
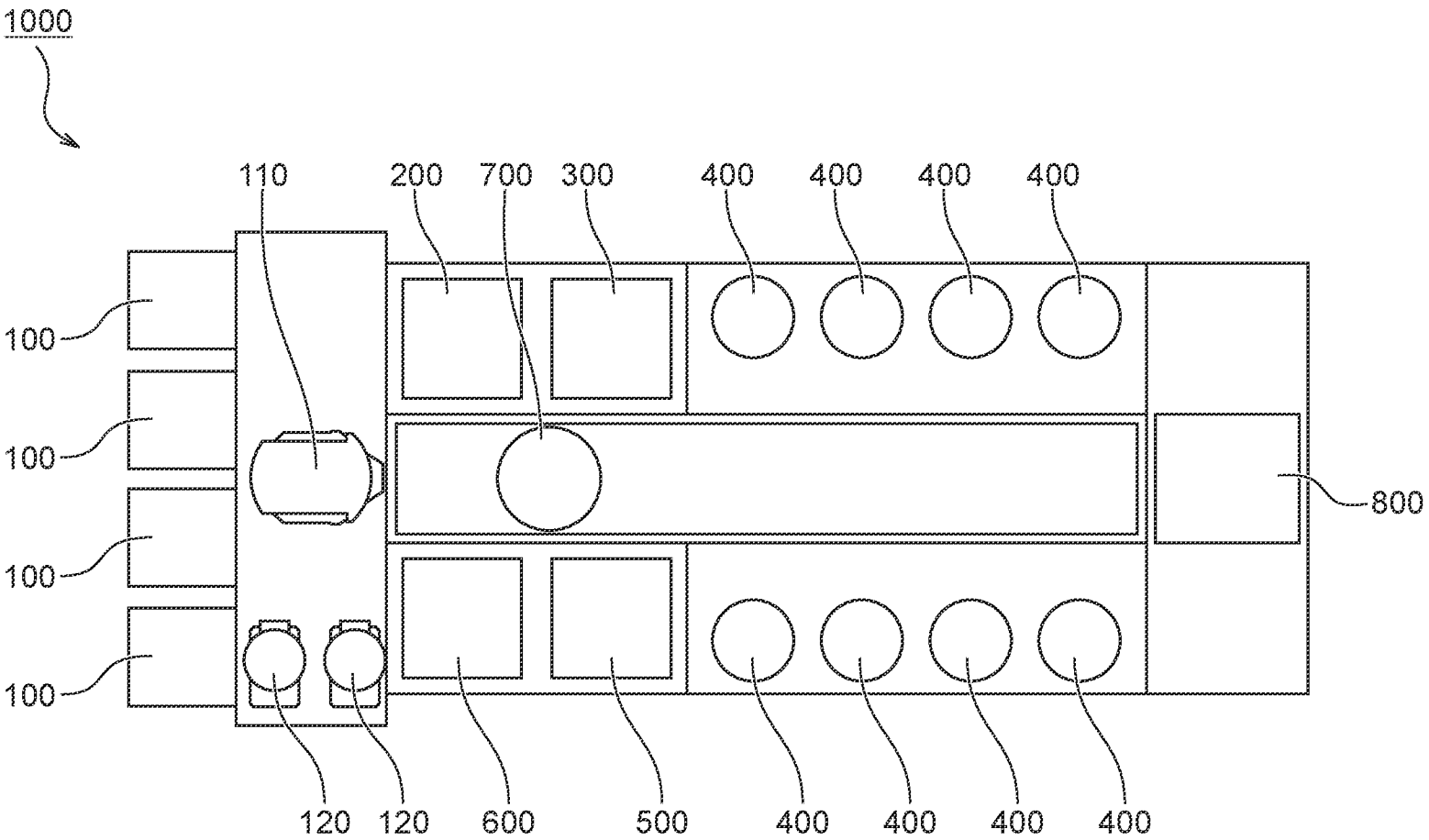
FIG. 2 is a plan view illustrating the overall configuration of the plating apparatus according to the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

The configuration of the plating apparatus 1000 illustrated in FIG. 1 and FIG. 2 is only one example, and the configuration of the plating apparatus 1000 is not limited to the configuration of FIG. 1 and FIG. 2.

[Plating Module]

The following describes the plating module 400. The plurality of plating modules 400 included in the plating apparatus 1000 of the embodiment have similar configurations. Accordingly the description regards one plating module 400.

Figure 3:
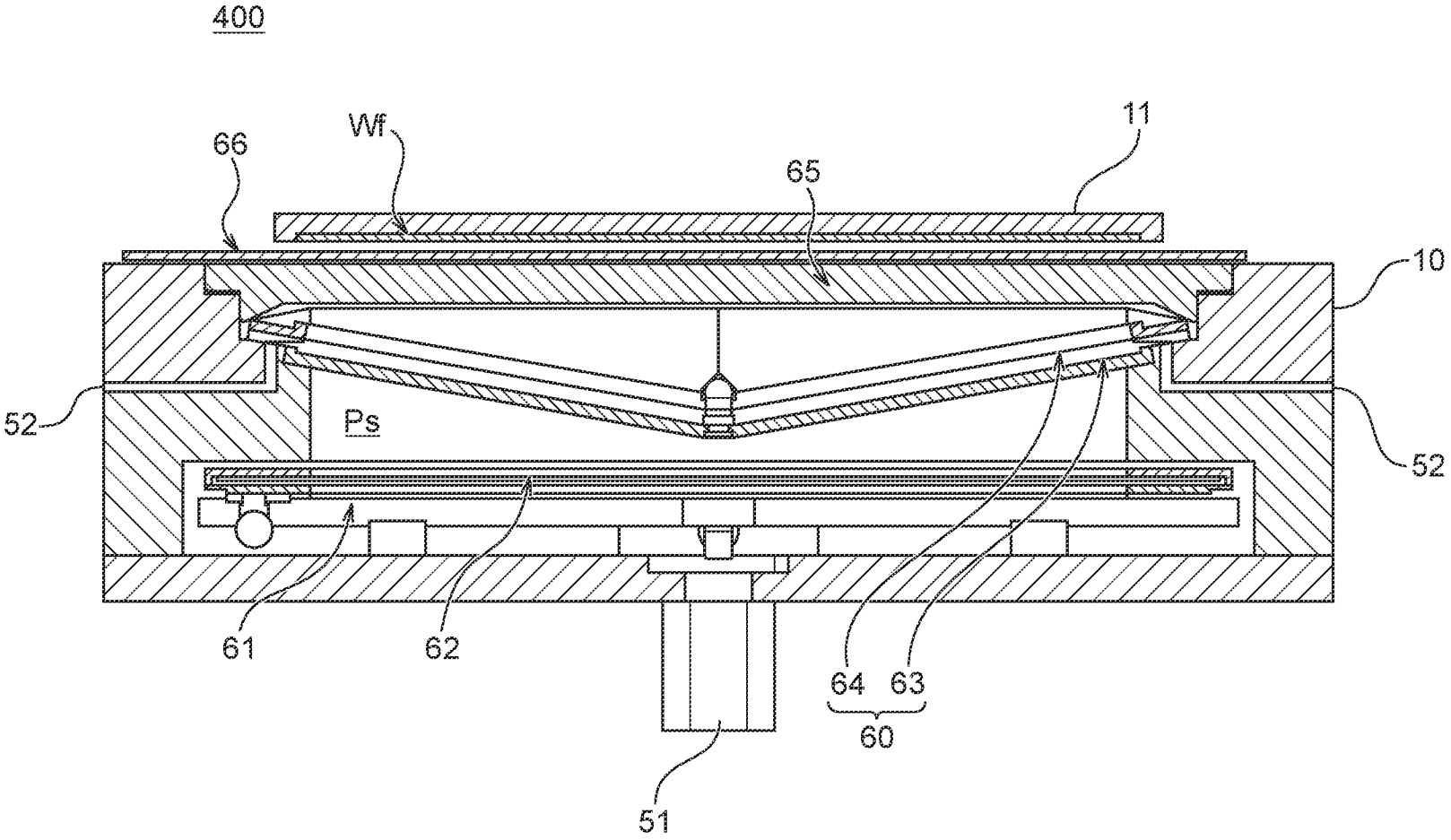
FIG. 3 is a sectional view illustrating the configuration of a plating module in the plating apparatus according to the embodiment.
Figure 4:
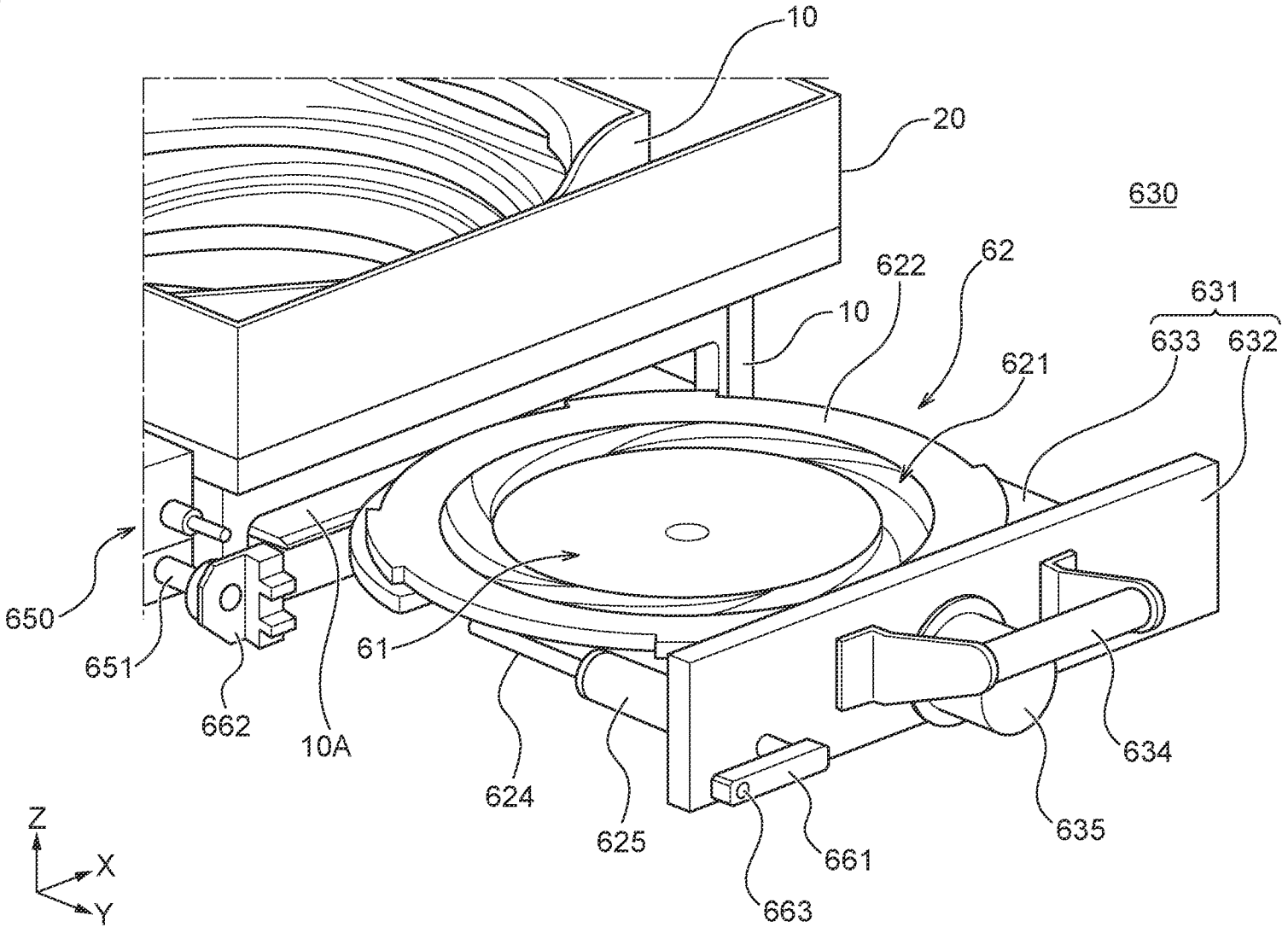
FIG. 4 is a perspective view illustrating the configuration of the plating module in the plating apparatus according to the embodiment.

FIG. 3 is a sectional view illustrating the configuration of the plating module in the plating apparatus according to the embodiment. FIG. 4 is a perspective view illustrating the configuration of the plating module in the plating apparatus according to the embodiment.

The plating apparatus 1000 according to the embodiment is a face down-type or a cup-type plating apparatus. The plating module 400 in the plating apparatus 1000 of the embodiment mainly includes a plating tank 10, an overflow tank 20, a substrate holder 11 configured to hold a substrate Wf and also called a plating head, and a rotating mechanism, a tilting mechanism and a lift mechanism (not shown) configured to rotate, tilt and lift up and down the substrate holder 11. The tilt mechanism may, however, be omitted.

The plating tank 10 according to the embodiment is configured by a bottomed vessel having an opening on an upper side thereof. The plating tank 10 has a bottom wall and a side wall extended upward from an outer periphery of this bottom wall and is open on an upper portion of this side wall.

The plating tank 10 has an internal space in a cylindrical shape to store a plating solution Ps. The plating solution Ps may be any solution including an ion of a metal element to form a plating film, and its concrete examples are not specifically limited. According to the embodiment, a copper plating process is employed as one example of a plating process, and a copper sulfate solution is used as one example of the plating solution Ps. According to the embodiment, the plating solution Ps includes a predetermined additive. The plating solution Ps is, however, not limited to this composition but may be prepared not to include any additive.

As shown in FIG. 4, the overflow tank 20 is configured by a bottomed vessel that is placed outside of the plating tank 10. The overflow tank 20 temporarily stores the plating solution Ps that overflows from an upper edge of the plating tank 10. In one example, the plating solution Ps in the overflow tank 20 is discharged from an outlet (not shown) for the overflow tank 20 is temporarily accumulated in a reservoir tank (not shown) and is returned to the plating tank 10.

An anode 61 is placed in a lower portion inside of the plating tank 10. The concrete type of the anode 61 is not specifically limited, but a soluble anode or an insoluble anode may be used. According to the embodiment, an insoluble anode is used as the anode 61. The concrete type of this insoluble anode is not specifically limited, but platinum, iridium oxide or the like may be used. According to the embodiment, a variable anode mask 62 is provided on an upper face side (substrate Wf-side) of the anode 61.

The variable anode mask 62 has an opening 62A which the anode 61 is exposed from and serves as an electric field regulating member configured to adjust an exposure range of the anode 61 by the opening 62A and thereby regulate an electric field from the anode 61 toward the substrate Wf. As shown in FIG. 4, the variable anode mask 62 of this embodiment is provided with a plurality of blades 621 to adjust the opening size of the opening 62A by a mechanism similar to an aperture or a diaphragm of a camera. The details of the variable anode mask 62 will be described later.

A diaphragm 60 is placed above the variable anode mask 62 inside of the plating tank 10. The inside of the plating tank 10 is parted into chambers on an upper side and on a lower side by the diaphragm 60. The chamber on the upper side of the diaphragm 60 is referred to as cathode chamber, and the chamber on the lower side of the diaphragm 60 is referred to as anode chamber. According to the embodiment, the diaphragm 60 includes a first membrane 63 as a neural membrane and a second membrane 64 as an ion exchange membrane. This configuration of the diaphragm 60 is, however, only one example, and the diaphragm 60 may have another configuration. Respective outer circumferential parts of the first membrane 63 and the second membrane 64 are fixed to an inner circumferential face of the plating tank 10 by supports. The plating solution Ps is supplied into the anode chamber through a liquid supply port 51 provided in the bottom wall of the plating tank 10 and is discharged from the anode chamber through a liquid discharge port 52 (two liquid discharge ports 52 according to the embodiment) provided in the side wall of the plating tank 10. The plating solution is also supplied into the cathode chamber through a non-illustrated liquid supply port and is discharged from the cathode chamber through a non-illustrated liquid discharge port. The plating solution Ps that includes the additive such as a promoter is introduced into the cathode chamber, whereas the plating solution Ps that does not include any additive or that has a low concentration of the additive is introduced into the anode chamber. The diaphragm 60 serves to allow the metal ion included in the plating solution to be transmitted from the anode chamber to the cathode chamber and to prevent the additive included in the plating solution from being transmitted from the cathode chamber to the anode chamber.

A porous resistor 65 is placed above the diaphragm 60 inside of the plating tank 10. More specifically, the resistor 65 is configured by a porous plate member having a plurality of pores (fine pores). The plating solution Ps on a lower side of the resistor 65 is allowed to pass through the resistor 65 and flow to an upper side of the resistor 65. This resistor 65 is a member provided to homogenize an electric field formed between the anode 61 and the substrate Wf. Placing such a resistor 65 in the plating tank 10 facilitates uniformization of the film thickness of a plating film (plating layer) formed on the substrate Wf. The resistor 65 is, however, not an essential component according to the embodiment, but the embodiment may be configured without the resistor 65.

A paddle 66 is placed in the vicinity of the substrate Wf (between the resistor 65 and the substrate Wf according to the embodiment) inside of the plating tank 10. The paddle 66 moves back and forth in a direction approximately parallel to a surface to be plated or a plating surface of the substrate Wf to generate a strong flow of the plating solution on the surface of the substrate Wf. This homogenizes the ion in the plating solution in the vicinity of the surface of the substrate Wf and improves the in-plane uniformity of the plating film formed on the surface of the substrate Wf.

[Drawer Unit]

Figure 5:
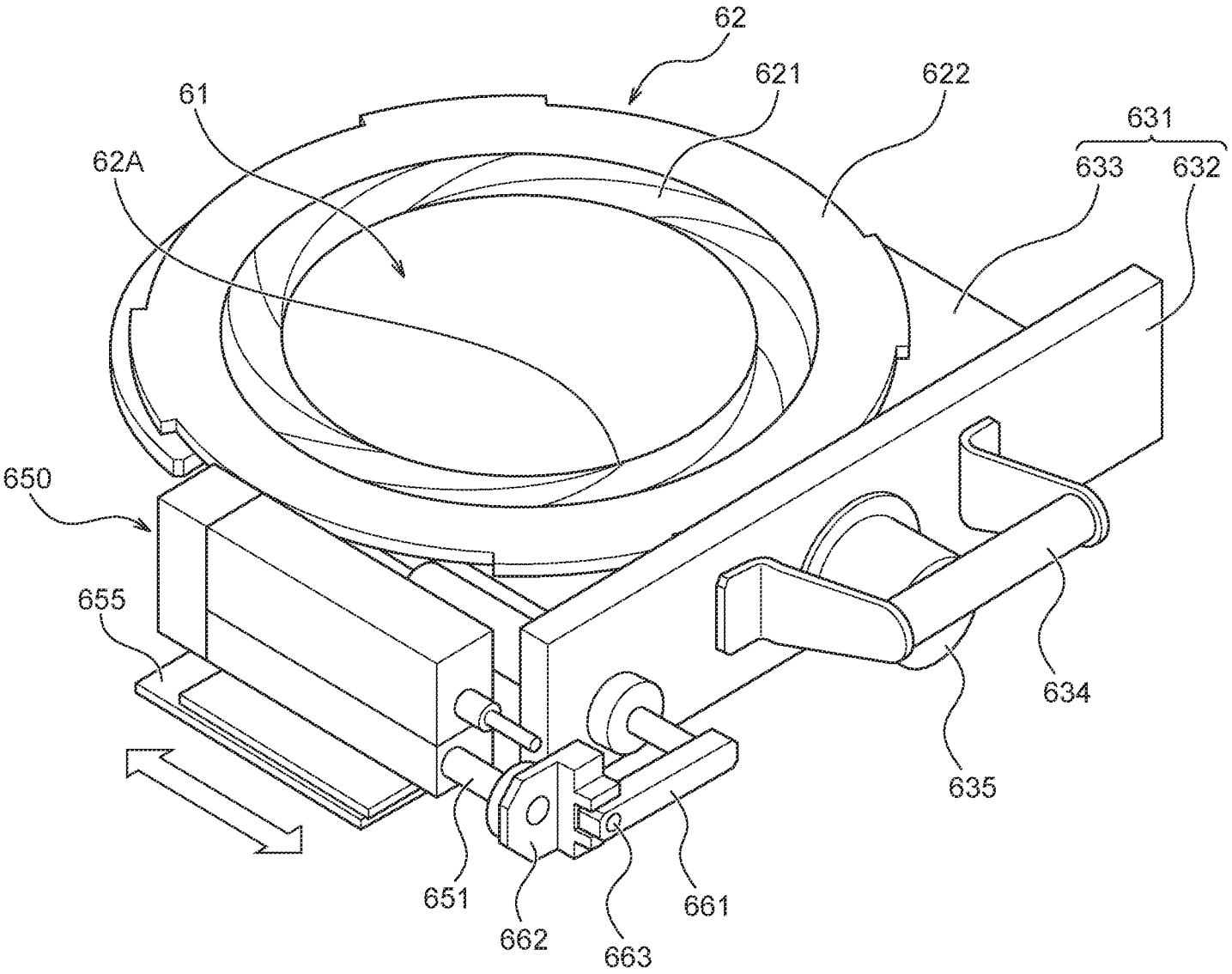
FIG. 5 is an upper side perspective view illustrating the configuration of a drawer unit.
Figure 6:
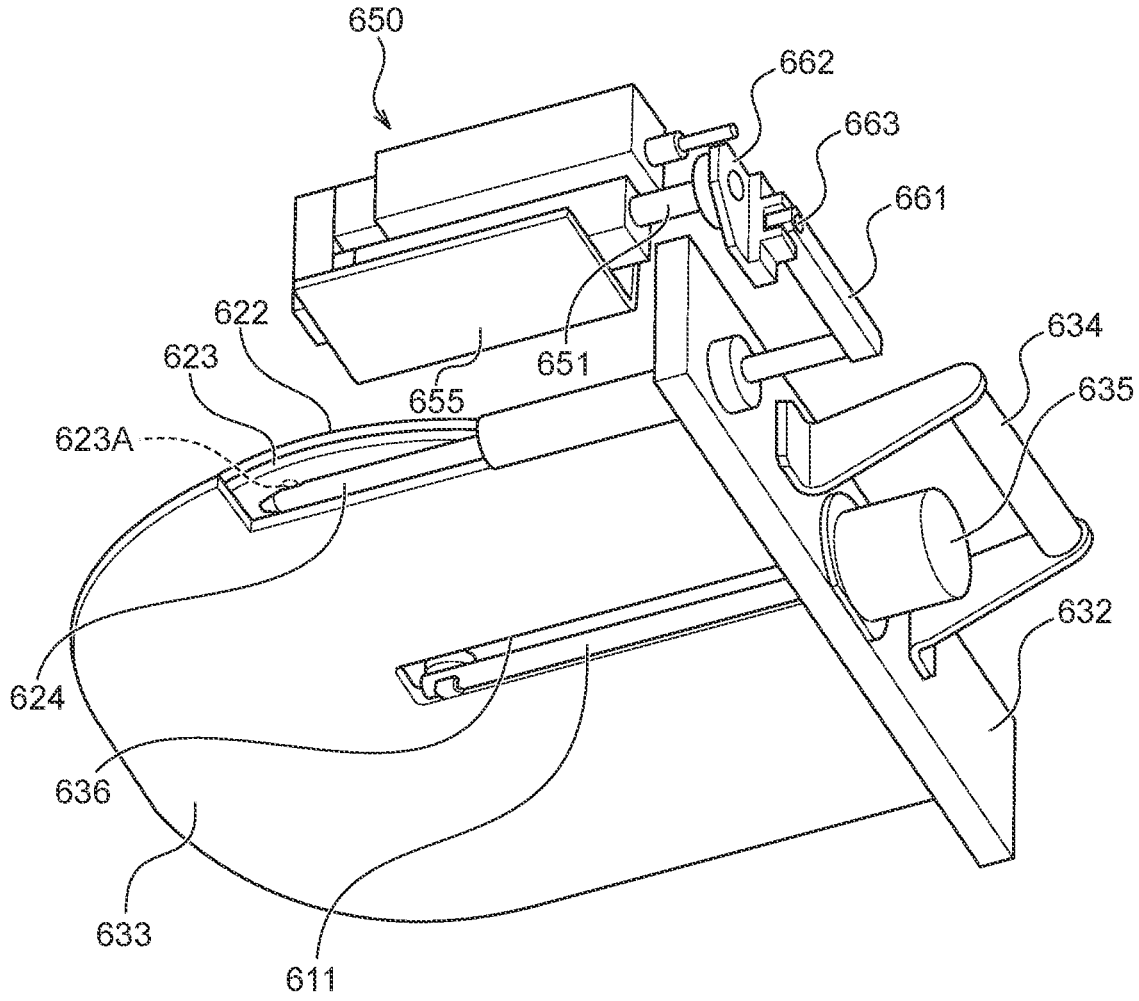
FIG. 6 is a lower side perspective view illustrating the configuration of the drawer unit.
Figure 7:
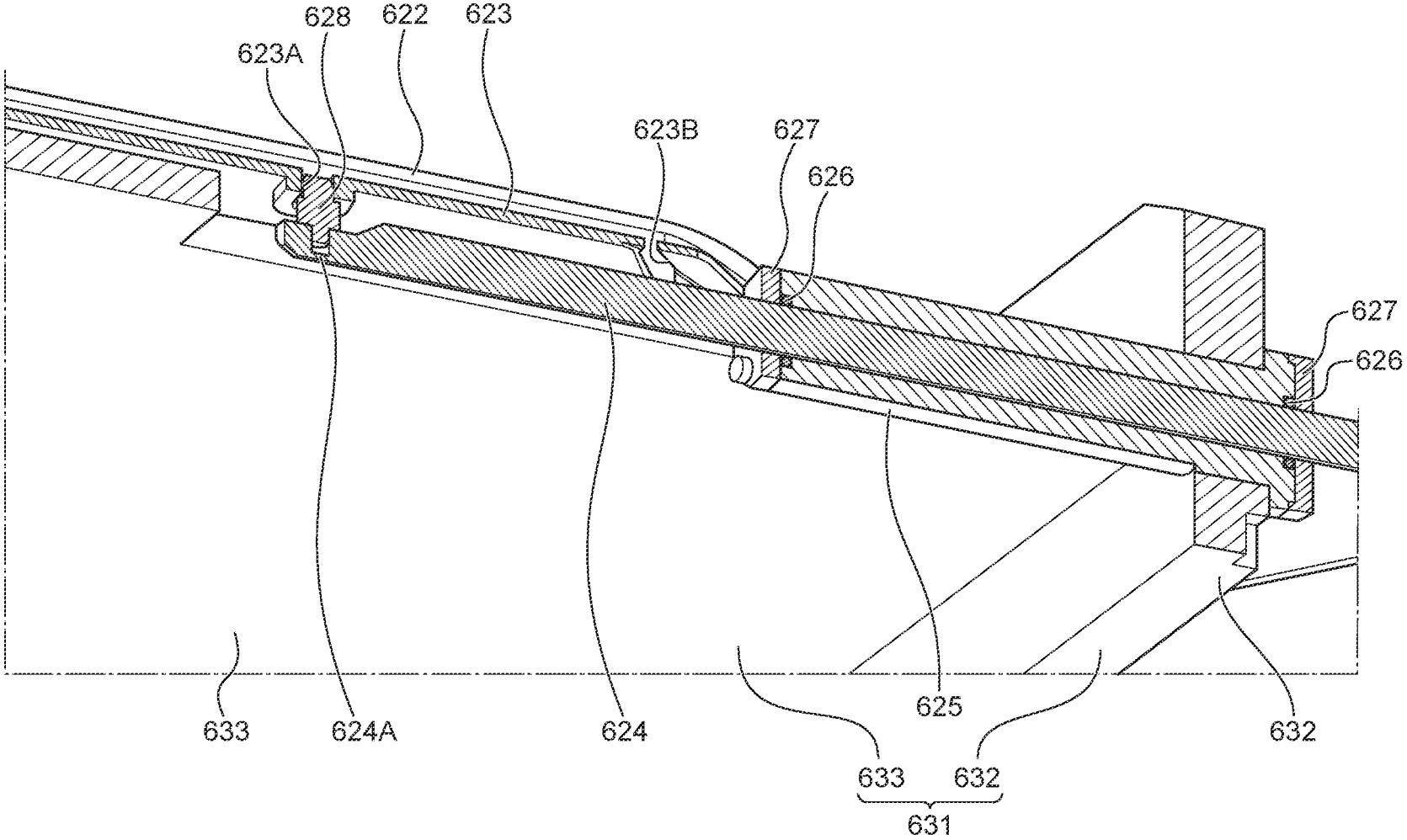
FIG. 7 is a cutaway perspective view illustrating the configuration of the drawer unit.
Figure 8:
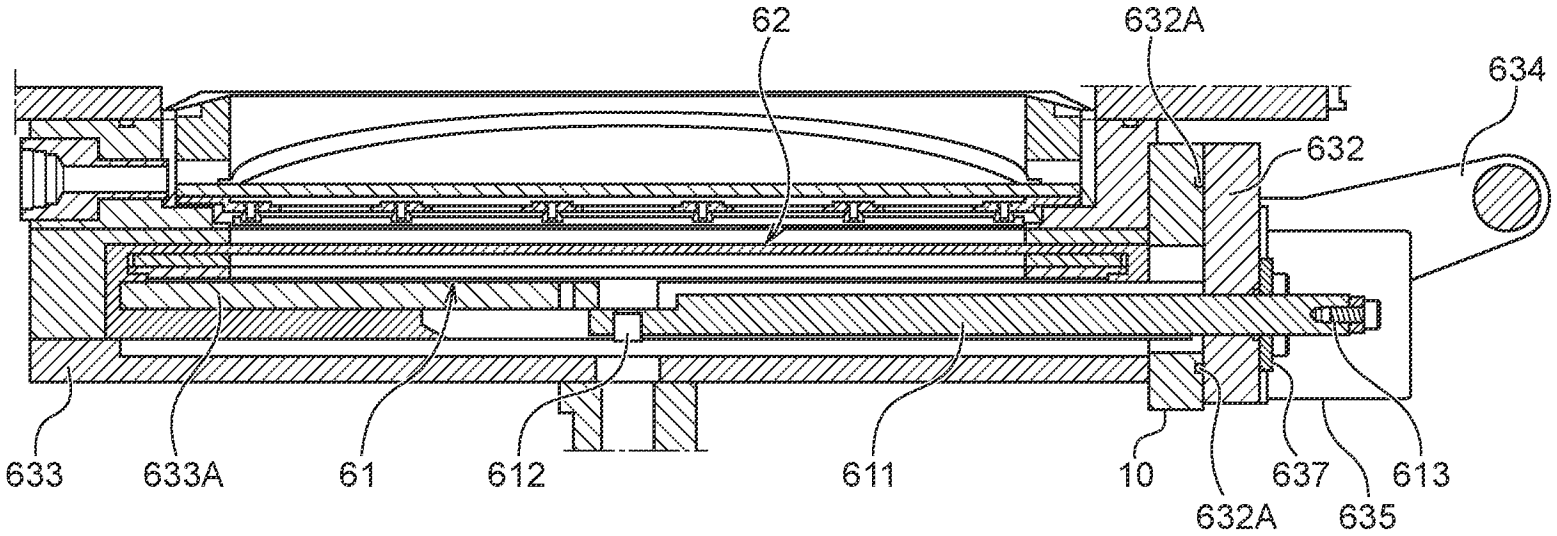
FIG. 8 is a vertical sectional view illustrating the configuration of the drawer unit.
Figure 9:
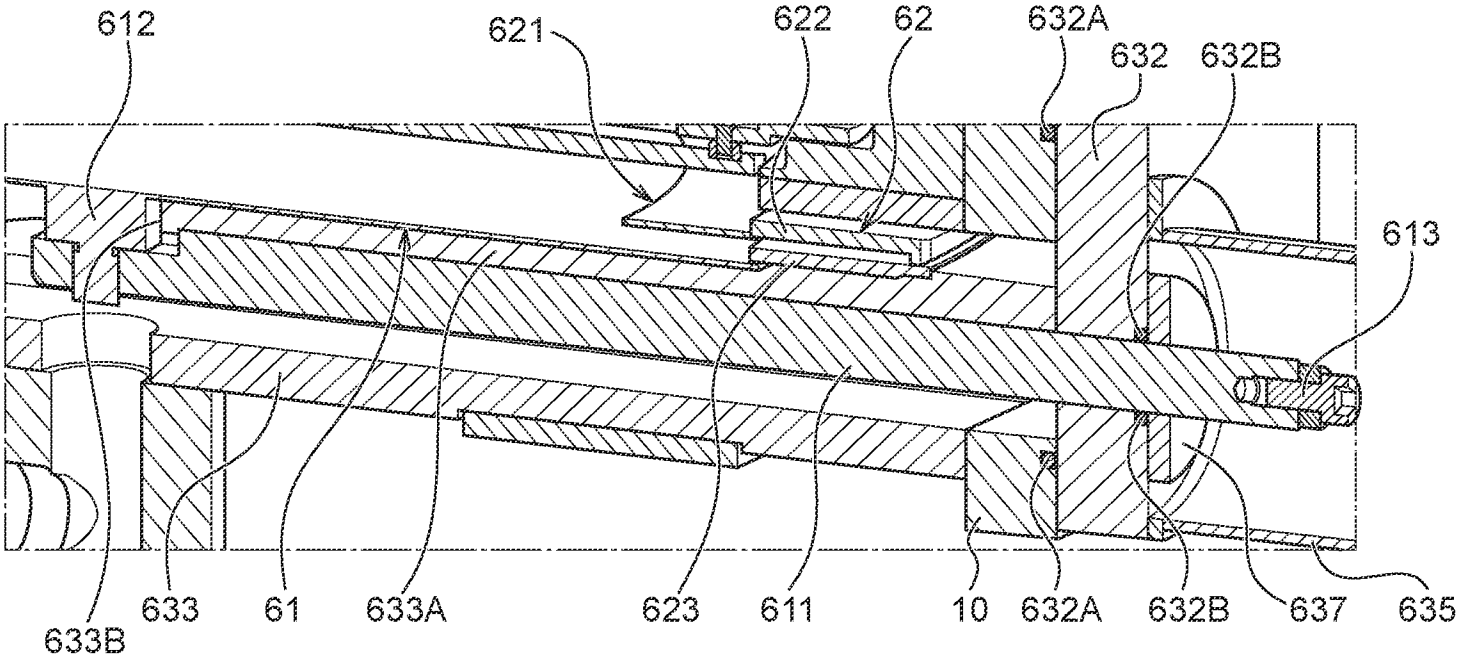
FIG. 9 is a cutaway perspective view illustrating the configuration of a bus bar of the drawer unit.

FIG. 5 is an upper side perspective view illustrating the configuration of a drawer unit. FIG. 6 is a lower side perspective view illustrating the configuration of the drawer unit. FIG. 7 is a cutaway perspective view illustrating the configuration of the drawer unit. FIG. 8 is a vertical sectional view illustrating the configuration of the drawer unit. FIG. 9 is a cutaway perspective view illustrating the configuration of a bus bar of the drawer unit. The following describes the drawer unit configured by integrating the anode 61 and the variable anode mask 62 with each other, with reference to FIG. 4 to FIG. 9.

According to the embodiment, as shown in FIG. 4 to FIG. 6, the anode 61 and the variable anode mask 62 are integrated with each other to configure a drawer unit 630. The drawer unit 630 includes a drawer main body 631, the anode 61, the variable anode mask 62, a drive shaft 624 configured to drive the variable anode mask 62, and a bus bar 611 configured to feed electric power to the anode 61. The bus bar 611 may, however, not be included in the drawer unit 630.

As shown in FIG. 4, the drawer unit 630 is configured to be inserted from an opening 10A that is open in the side wall of the plating tank 10, into inside of the plating tank 10. In the state that the drawer unit 630 is inserted into the plating tank 10 to be placed inside of the plating tank 10, a front plate 632 closes the opening 10A in side wall of the plating tank 10 to serve as part of the side wall of the plating tank 10 and to form part of the side wall of the plating tank 10.

The drawer main body 631 is made of an electrical insulating material and includes a bottom plate 633 and the front plate 632. In the description hereof, a front plate 632-side may be referred to as a front side, and a bottom plate 633-side may be referred to as a rear side. The bottom plate 633 is a plate-like member and serves to hold the anode 61 and the variable anode mask 62. The bottom plate 633 has an opening 636 for liquid drainage as shown in FIG. 6. The opening 636 is provided as one slit extended in a front-back direction in this drawing. The opening 636 may, however, be formed in any shape, and a plurality of the openings 636 may be provided. Providing the opening 636 reduces the amount of the plating solution left on the drawer unit 630 when the drawer unit 630 is drawn out of the plating tank 10 and suppresses the plating solution from being accumulated on the drawer unit 630.

The front plate 632 is attached to a front edge of the bottom plate 633 to configure part of the side wall of the plating tank 10. The front plate 632 is attached to the front edge of the bottom plate 633 by a fastening member, such as a bolt. The front plate 632 may be formed integrally with the bottom plate 633. When the drawer unit 630 is inserted from the opening 10A in the side wall of the plating tank 10 into inside of the plating tank 10 to be placed inside of the plating tank 10, the front plate 632 closes the opening 10A to form part of the side wall of the plating tank 10. FIG. 8 illustrates the state that the drawer unit 630 is placed and fixed inside of the plating tank 10.

Figure 10:
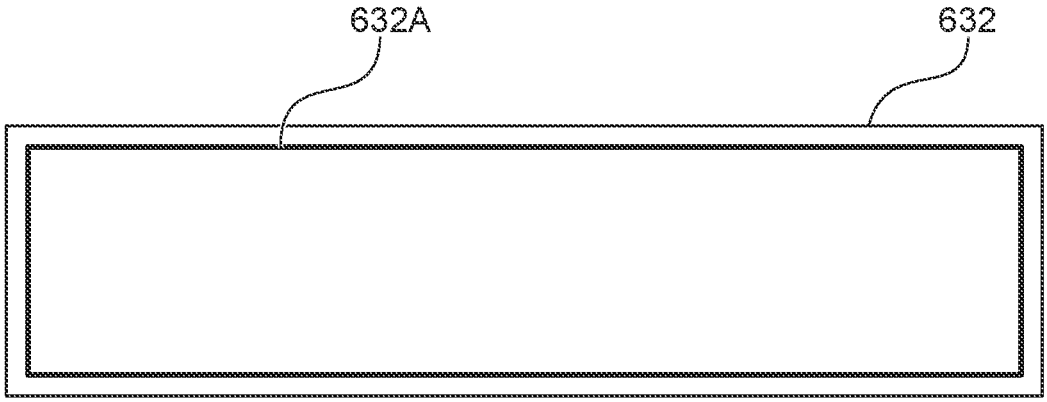
FIG. 10 is a plan view illustrating an arrangement of seals in a front plate.

The front plate 632 of the drawer unit 630 may be fixed to the side wall of the plating tank 10 by, for example, any fastening member, such as a bolt or a screw. A seal 632A is provided in a rear face (inner face) of the front plate 632 or in part of an outer face of the side wall of the plating tank 10 that is opposed to the inner face of the front plate 632, to seal between the front plate 632 and the side wall of the plating tank 10 and prevent a leakage of the plating solution. This seal 632A is provided in, for example, in a ring shape around an outer peripheral portion of the inner face of the front plate 632 as shown in FIG. 10.

A handle 634 is provided on a front face (an outer face) of the front plate 632 to be held by an operator when the drawer unit 630 is drawn into and out of the plating tank 10. The handle 634 may be attached to the front plate 632 by fastening of, for example, a bolt, a screw or the like. The handle 634 may be formed integrally with the front plate 632. An insulating cover 635 is mounted to the approximate center of the front plate 632 to cover the bus bar 611 (shown in FIG. 6) that is pierced through the front plate 632 to be exposed.

The anode 61 is a plate-like electrode and has, for example, a disk shape. As shown in FIG. 9, the anode 61 has a projection 612 provided at the center of a reverse surface thereof to serve as a power feed point. The anode 61 is placed on a base 633A provided on the bottom plate 633. For example, a recess corresponding to the outer shape of the anode 61 is provided on an upper face of the base 633A, and the anode 61 is fit in this recess to be fixed. The base 633A is made of an electrical insulating material. The base 633A has a hole 633B that is provided at a position corresponding to the projection 612 of the anode 61. The projection 612 of the anode 61 passes through the hole 633B, and a leading end of the projection 612 is mechanically and electrically connected with the bus bar 611.

The bus bar 611 has one end (inner side end, rear side end) that is electrically and mechanically connected with the projection 612 of the anode 61 and the other end side that is pierced through the front plate 632 to be exposed on an outer face side of the front plate 632. A cable for power feeding is fixed to the other end (outer side end, front side end) of the bus bar 611 by a fastening member 613, such as a bolt or a screw. The cable for power feeding receives a supply of electric power from a power source (not shown). A seal 632B is provided between the front plate 632 and the bus bar 611 to prevent a leakage of the plating solution. The seal 632B is fixed by a seal fixation member 637. As shown in FIG. 8, the insulating cover 635 is mounted around the outer side end of the bus bar 611 on the front plate 632 to prevent the operator from touching a high voltage part. The insulating cover 635 is attached to the front plate 632 by fastening of, for example, a bolt, a screw or the like. As shown in FIG. 5 and FIG. 8, the insulating cover 635 that covers an exposed portion of the bus bar 611 from the front plate 632 is placed on a slightly lower side of the approximate center in a width direction of the front face of the front plate 632.

The variable anode mask 62 has a structure similar to that of the aperture mechanism of the camera and is configured to move the plurality of blades 621, such as expand and contract the opening size of the opening 62A of the variable anode mask 62. As shown in FIG. 5 and FIG. 9, the variable anode mask 62 includes a cam disk 623 placed away from a face of the anode 61 by a predetermined distance to surround the outer circumference of the anode 61 on the base 633A, a blade retainer 622 placed above the cam disk 623, and the plurality of blades 621 placed between the cam disk 623 and the blade retainer 622.

As shown in FIG. 9, the cam disk 623 is a ring-shaped member and is placed on the base 633A. The cam disk 623 is placed to be rotatable on the base 633A. For example, the cam disk 623 is fit in a recess provided on an upper face of the base 633A to be supported in a rotatable manner. As shown in FIG. 7, the cam disk 623 is provided with a hole 623A which a pin 628 for fixing the drive shaft 624 is engaged with and fixed in, and with a long hole 623B which a pin (not shown) provided on a lower face of each blade 621 is engaged with. The cam disk 623 is rotated on the base 633A by backward and forward motions of the drive shaft 624, such as to rotate the plurality of blades 621 and adjust the opening size of the opening 62A of the variable anode mask 62 (shown in FIG. 5).

As shown in FIG. 5, the blade retainer 622 is a ring-shaped member and has an outer diameter slightly larger than the outer diameter of the cam disk 623. As shown in FIG. 9, the blade retainer 622 is placed above the plurality of blades 621. The blade retainer 622 is fixed to the base 633A to be not rotatable. A plurality of pins (not shown) are provided on a lower face of the blade retainer 622. Each pin is engaged with a circular hole (not shown) provided on an upper face of each blade 621 such as to allow each blade 621 to rotate around the pin. Each blade 621 is rotated by the rotation of the cam disk 623 such as to rotate around the pin of the blade retainer 622. According to a modification, the blade retainer 622 may be provided with circular holes, and each blade 621 may be provided with a pin.

The plurality of blades 621 have a structure similar to that of the blades of the aperture mechanism of the camera and are placed around the opening 62A of the variable anode mask 62. The plurality of blades 621 are mounted to the cam disk 623 and the blade retainer 622 to be movable such as to expand and contract the opening size of the opening 62A of the variable anode mask 62.

The drive shaft 624 is fixed to the cam disk 623 by the pin 628 on a rear end (inner side end) of the drive shaft 624 as shown in FIG. 7. In this example, the pin 628 is engaged with the hole 623A provided in the cam disk 623 and with a hole 624A provided in a rear end of the drive shaft 624, so that the drive shaft 624 is connected with the cam disk 623. As shown in FIG. 5, when an output shaft 651 of an actuator 650 moves back and forth in a front-back direction, the drive shaft 624 moves in a direction identical with and parallel to the moving direction of the output shaft 651 of the actuator 650 via joints 661, 662 and 663, so as to rotate the cam disk 623.

As shown in FIG. 7, the drive shaft 624 passes through a bearing 625 in a cylindrical shape that is attached to be pierced through the front plate 632, and penetrates between the outer face and the inner face of the front plate 632. In more detail, the drive shaft 624 is placed to penetrate through the bearing 625 and seals 626 and seal fixation members 627 that are provided on respective end faces of the bearing 625. The seals 626 serve to seal between the bearing 625 and the drive shaft 624, such as to prevent a leakage of the plating solution from between the bearing 625 and the drive shaft 624 to outside. In this example, the seals 626 are placed inside of ring-shaped grooves provided in the respective end faces of the bearing 625 and are pressed and fixed by the seal fixation members. 627. For example, Omniseals having a resin provided around a ring-shaped metal core member may be employed for the seals 626. Employing the Omniseals lowers the sliding resistance against the drive shaft 624 and enables the drive shaft 624 to be smoothly moved forward and backward. The seals 626 may, however, be O-rings or any other seals according to the specification of the apparatus. The seal fixation members 627 are fixed to the respective end faces of the bearing 625 by, for example, fastening members, such as bolts or screws.

The drive shaft 624 configured to drive the variable anode mask 62 is driven by the actuator 650 fixed on the plating tank 10-side as shown in FIG. 4 and FIG. 5. The plating tank 10 is omitted from the illustration of FIG. 5, in order to show the mechanical connection between the actuator 650 and the drive shaft 624 in an easy-to-understand manner. As shown in FIG. 4, the actuator 650 is fixed to a side wall face that is adjacent to the side wall face of the plating tank 10 provided with the opening 10A. The actuator 650 is attached to the outer face of the side wall of the plating tank 10, for example, by using a bracket 655 (shown in FIG. 5).

In this example, the actuator 650 is provided with a motor in an upper portion thereof and the output shaft 651 in a lower portion thereof and is configured to convert the rotation of the motor into the linear reciprocating motion of the output shaft 651. The actuator may be a fluid (for example, air or hydraulic)-driven type, an electromagnetic-driven type, such as a solenoid-driven type, or any other type of the actuator. The output shaft 651 of the actuator 650 is moved back and forth in the front-back direction by the power of a fluid or the like (by the rotation of the motor according to the embodiment).

A first joint 661 is coupled with a front end (outer side end) of the drive shaft 624 of the variable anode mask 62, whereas a second joint 662 is coupled with a leading end of the output shaft 651 of the actuator 650. As shown in FIG. 5, the first joint 661 and the second joint 662 are coupled with each other in a detachable manner by any fastening member 663, such as a bolt or a screw, so that the power is transmitted from the actuator 650 to the drive shaft 624. According to the embodiment, the drive shaft 624 of the variable anode mask 62 and the output shaft 651 of the actuator 650 are placed parallel to each other. When the output shaft 651 of the actuator 650 is moved back and forth in the front-back direction, the drive shaft 624 of the variable anode mask 62 is moved in a direction identical with and parallel to the moving direction of the output shaft 651 of the actuator 650.

According to the embodiment, the second joint 662 is provided with a guide element configured to vertically guide an end portion of the first joint 661. The guide element stops rotation of the first joint 661 and enables the first joint 661 in a stable posture to be attached to the second joint 662. The first joint 661 may be a plate-like or rod-like member and may be provided integrally with the front end of the drive shaft 624 or may be coupled with the front end of the drive shaft 624 by any fastening member, such as a bolt or a screw. The second joint 662 may be a plate-like or rod-like member and may be provided integrally with the leading end of the output shaft 651 or may be coupled with the leading end of the output shaft 651 by any fastening member, such as a bolt or a screw.

Figure 11:
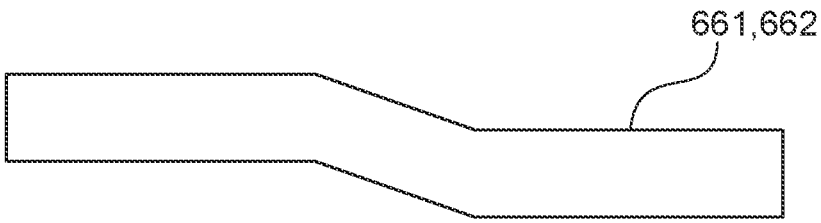
FIG. 11 is a schematic diagram illustrating a modification of joints.

In the case where the output shaft 651 of the actuator 650 and the drive shaft 624 of the variable anode mask 62 are placed at different heights, one or both of the first joint 661 and the second joint 662 may be provided with a crank as shown in FIG. 11. For example, a crank may be provided to make the height of a drive shaft 624-side end and a second joint 662-side end of the first joint 661 different from each other. In another example, a crank may be provided to make the height of an output shaft 651-side end and a first joint 661-side end of the second joint 662 different from each other. The height of a location of the second joint 662 to be fixed to the output shaft 651 may be made different from the height of a location of the second joint 662 to be fixed to the first joint 661.

The following describes a method of manufacturing the plating module 400 described above or more specifically a process of mounting the drawer unit 630 to the plating tank 10. The process of mounting the drawer unit 630 to the plating tank 10 includes at least processes given below:

(a) a process of providing the plating tank 10 prior to mounting of the drawer unit 630;

(b) a process of inserting the drawer unit 630, which at least the anode 61, the variable anode mask 62 and the drive shaft 624 configured to drive the variable anode mask 62 are mounted to, from the opening 10A in the side wall of the plating tank 10 into inside of the plating tank 10, so as to place the drawer unit 630 inside of the plating tank 10;

(c) a process of mounting the actuator 650 to the outer face of the side wall of the plating tank 10; and (d) a process of mounting the front end of the drive shaft 624 of the drawer unit 630 to the leading end of the output shaft 651 of the actuator 650 via the joints 661, 662 and 663.

Either of the process (c) and the process (d) may be performed first.

In the drawer unit 630 placed in the plating tank 10, driving the actuator 650 moves the drive shaft 624 of the drawer unit 630 in the front-back direction, rotates the cam disk 623, and rotates the plurality of blades 621, so as to adjust the opening size of the opening 62A of the variable anode mask 62.

For the purpose of maintenance of the anode 61 and/or the variable anode mask 62, the drawer unit 630 is demounted from the plating tank 10 by a procedure described below. The procedure first releases the joint between the drive shaft 624 of the drawer unit 630 and the output shaft 651 of the actuator 650. More specifically, the procedure detaches the fastening member 663 that is used to fasten the first joint 661 and the second joint 662. The procedure also detaches the fastening member, such as a bolt or a screw, that is used to fix the front plate 632 of the drawer unit 630 to the side wall of the plating tank 10. Either of the release of the joint and the detachment of the fastening member of the front plate may be performed first. The procedure then draws out of and demounts the drawer unit 630 from the plating tank 10. This configuration enables the anode 61 and/or the variable anode mask 62 to be demounted from the plating tank 10 for the purpose of maintenance, without detachment of the components in the plating tank 10 above the anode 61 and/or the variable anode mask 62. The maintenance includes, for example, inspection, cleaning, replacement of parts, and adjustment of the anode, the variable anode mask and other components (for example, the bus bar).

The embodiment described above has the following functions and advantageous effects:

(1) The configuration of the above embodiment enables the drawer unit 630 configured by integrating the anode 61 and the variable anode mask 62 with each other, to be drawn out of the plating tank 10, so as to facilitate maintenance and/or replacement of the anode and the variable anode mask. The drawer is configured by the front plate and the bottom plate. This simple configuration assures the height where the anode and the variable anode mask are to be drawn in and drawn out.

(2) The configuration of the above embodiment enables the drive shaft 624 of the variable anode mask 62 and the output shaft 651 of the actuator 650 to be attached to and detached from each other via the joints, outside of the plating tank 10. This configuration accordingly enables the drawer unit 630 to be readily mounted to and to be readily demounted from the plating tank 10.

(3) According to the above embodiment, the drive shaft 624 of the variable anode mask 62 is placed parallel to the output shaft 651 of the actuator 650 and is moved in the identical direction. The power transmission mechanism is thus readily configured by simply coupling the drive shaft 624 of the variable anode mask 62 with the output shaft 651 of the actuator 650 via the joints or the like.

At least the following aspects are provided from the above description of the embodiment.

[1] According to one aspect, there is provided an apparatus for plating, comprising: a plating tank configured to store a plating solution therein; a substrate holder configured to hold a substrate in such a state that a plating surface of the substrate faces down; and a drawer unit mounted to the plating tank to be freely drawable in a horizontal direction and provided with an anode that is placed to be opposed to the substrate in the plating tank and with a variable anode mask that includes an opening which the anode is exposed from and that is configured to adjust an opening size of the opening.

The configuration of this aspect enables the drawer unit configured by integrating the anode and the variable anode mask with each other, to be drawn out of the plating tank. This configuration accordingly facilitates maintenance and/or replacement of the anode and the variable anode mask.

[2] According to one aspect, the apparatus for plating may further comprise an actuator placed on a plating tank side and provided with an output shaft to be freely movable forward and backward, wherein the variable anode mask may comprise an opening adjustment member configured to adjust the opening size of the opening, and the drawer unit may further comprise a drive shaft configured to move the opening adjustment member of the variable anode mask, wherein the drive shaft of the drawer unit may be connected with the output shaft of the actuator in a detachable manner, outside of the plating tank, and power of the actuator may be transmitted to the drive shaft of the drawer unit. The opening adjustment member may comprise, for example, a plurality of blades operated by a structure similar to an aperture mechanism of a camera.

The configuration of this aspect enables the drive shaft of the variable anode mask to be detached from the output shaft of the actuator, outside of the plating tank and thereby enables the drawer unit configured by integrating the anode and the variable anode mask with each other, to be readily drawn out of the plating tank. Furthermore, in the case of mounting the drawer unit to the plating tank, this configuration enables the drive shaft of the drawer unit to be attached to the output shaft of the actuator, outside of the plating tank, and thereby enables the drawer unit configured by integrating the anode and the variable anode mask with each other, to be readily mounted to the plating tank.

[3] According to one aspect, the drive shaft of the drawer unit may be connected with the output shaft of the actuator via a joint in a detachable manner.

The configuration of this aspect releases the joint and detaches the drive shaft of the variable anode mask from the output shaft of the actuator, outside of the plating tank. This configuration accordingly enables the drawer unit configured by integrating the anode and the variable anode mask with each other, to be readily drawn out of the plating tank. This configuration also enables the drive shaft of the variable anode mask to be attached to the output shaft of the actuator via the joint, outside of the plating tank.

[4] According to one aspect, the output shaft of the actuator may be placed parallel to the drive shaft of the drawer unit, and the drive shaft of the drawer unit may be moved in an identical direction with the output shaft of the actuator.

The configuration of this aspect causes the drive shaft of the variable anode mask to be moved in the identical direction with the output shaft of the actuator. A power transmission mechanism is thus readily configured by simply coupling the drive shaft of the variable anode mask with the output shaft of the actuator via a joint or the like.

[5] According to one aspect, the drawer unit may comprise a bottom plate with the anode and the variable anode mask placed thereon, and a front plate forming part of a side wall of the plating tank, wherein the drive shaft may be pierced through the front plate and may be connected with the output shaft of the actuator, outside of the plating tank.

The configuration of this aspect causes the drive shaft of the variable anode mask to be pierced through the front plate of the drawer unit that forms part of the side wall of the plating tank. This enables one end of the drive shaft of the variable anode mask to be placed outside of the plating tank and thereby enables the drive shaft of the variable anode mask and the output shaft of the actuator to be readily connected with each other and disconnected from each other, outside of the plating tank. Furthermore, the front plate of the drawer unit forms part of the side wall of the plating tank. There is accordingly no need to provide the plating tank additionally with an opening and a cover such as to enable the drawer unit to be drawn in and out of the plating tank.

[6] According to one aspect, the drawer unit may further comprise a bearing provided to pass through the front plate and configured to guide the driveshaft, and seals provided on respective ends of the bearing and configured to seal between the driveshaft and the bearing.

The configuration of this aspect enables one end of the drive shaft of the variable anode mask to be placed outside of the plating tank, while preventing a leakage of the plating solution from the plating tank.

[7] According to one aspect, the drawer unit may comprise a bus bar electrically connected with the anode to feed electric power to the anode, and the bus bar may be pierced through the front plate and is extended to outside of the plating tank.

The configuration of this aspect enables the drawer unit configured by integrating the anode, the variable anode mask, the drive shaft of the variable anode mask, and the bus bar configured to feed electric power to the anode with one another, to be drawn out of the plating tank. This configuration also enables the bus bar to be readily connected with an external wiring, outside of the plating tank.

[8] According to one aspect, the bottom plate may be provided with an opening for liquid drainage.

The configuration of this aspect reduces the amount of the plating solution left in the drawer unit when the drawer unit is drawn out of the plating tank, and suppresses the plating solution from being accumulated in the drawer unit.

[9] According to one aspect, the joint may comprise a first member that is a plate-like or rod-like member and that is provided to be integrated with one end of the drive shaft or that is coupled with the one end of the drive shaft; a second member that is a plate-like or rod-like member and that is provided to be integrated with a leading end of the output shaft of the actuator or that is coupled with the leading end of the output shaft; and a fastening member configured to couple the first member with the second member in a detachable manner.

The configuration of this aspect implements the joint used to connect the drive shaft of the anode mask with the output shaft of the actuator by the simple and the reliable structure.

[10] According to one aspect, at least one of the first member and the second member may have a crank, and the one end of the drive shaft and the leading end of the output shaft of the actuator may be placed at different heights.

The configuration of this aspect enables the drive shaft of the variable anode mask and the output shaft of the actuator to be readily and reliably connected with each other even in the case where the drive shaft of the variable anode mask and the output shaft of the actuator are placed at different heights.

[11] According to one aspect, the fastening member may be a bolt or a screw.

The configuration of this aspect readily and reliably configures the joint that is used to connect the drive shaft of the variable anode mask with the output shaft of the actuator.

[12] According to one aspect, the drawer unit may comprise a bottom plate with the anode and the variable anode mask placed thereon, and a front plate forming part of a side wall of the plating tank.

The configuration of this aspect readily assures a space in a height direction for placing therein the variable anode mask that has a larger thickness than the thickness of the anode, by the simple structure of the bottom plate and the front plate.

[13] According to one aspect, there is provided a method of manufacturing an apparatus for plating. The method comprises providing a plating tank; inserting a drawer unit comprising at least a bottom plate configured to hold an anode and a variable anode mask, a front plate provided to form part of a side wall of the plating tank, and a drive shaft pierced through the front plate and configured to drive the variable anode mask, into the plating tank; mounting an actuator to an outer face of the side wall of the plating tank at a location other than the front plate; and connecting the drive shaft of the drawer unit with an output shaft of the actuator in a detachable manner, outside of the plating tank.

The configuration of this aspect enables the drawer unit configured by integrating the anode, the variable anode mask and the drive shaft of the variable anode mask with one another, to be drawn out of the plating tank and thereby facilitates maintenance and/or replacement of the anode, the variable anode mask and the drive shaft of the variable anode mask.

[14] According to one aspect, the drawer unit may further comprise a bus bar configured to feed electric power to the anode.

The configuration of this aspect enables the drawer unit configured by integrating the anode, the variable anode mask, the drive shaft of the variable anode mask, and the bus bar configured to feed electric power to the anode with one another, to be drawn out of the plating tank and thereby facilitates maintenance and/or replacement of the anode, the variable anode mask, the drive shaft of the variable anode mask and the bus bar configured to feed electric power to the anode.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit the embodiments and the modifications described above and it is also possible to arbitrarily combine or omit respective constituent elements described in the claims and the specification in a range where at least a part of the above-mentioned problem can be solved or a range where at least a part of the effect is exhibited.

The entire disclosure of Japanese Unexamined Patent Publication No. 2006-241599 (PTL 1) and Description of U.S. Pat. No. 7,351,314 (PTL 2) including the specification, claims, drawings and abstract is incorporated herein by reference in its entirety.

REFERENCE SIGNS LIST

10 plating tank
10A opening
11 substrate holder
20 overflow tank
60 diaphragm
61 anode
62 variable anode mask
62A opening
65 resistor
66 paddle
611 bus bar
612 projection
613 fastening member
621 blade
622 blade retainer
623 cam disk
623 A hole
623B long hole
624 drive shaft
625 bearing
626 seal
627 seal fixation member
628 pin
630 drawer unit
631 drawer main body
632 front plate
632A seal
632B seal
633 bottom plate
633A base
633B hole
634 handle

635 insulating cover
650 actuator
651 output shaft
655 bracket
661 first joint
662 second joint
663 fastening member
636 opening
637 seal fixation member

The invention claimed is:

1. An apparatus for plating, comprising:

a plating tank configured to store a plating solution therein;

a substrate holder configured to hold a substrate in such a state that a plating surface of the substrate faces down;

a drawer unit mounted to the plating tank to be freely drawable in a horizontal direction and provided with an anode that is placed to be opposed to the substrate in the plating tank and with a variable anode mask that includes an opening which the anode is exposed from and that is configured to adjust an opening size of the opening; and an actuator placed on a plating tank side and provided with an output shaft to be freely movable forward and backward, wherein the variable anode mask comprises an opening adjustment member configured to adjust the opening size of the opening, and the drawer unit further comprises a drive shaft configured to move the opening adjustment member of the variable anode mask, wherein the drive shaft of the drawer unit is connected with the output shaft of the actuator in a detachable manner, outside of the plating tank, and power of the actuator is transmitted to the drive shaft of the drawer unit.

2. The apparatus for plating according to claim 1, wherein the drive shaft of the drawer unit is connected with the output shaft of the actuator via a joint in a detachable manner.

3. The apparatus for plating according to claim 2, wherein the joint comprises:

a first member that is a plate-like or rod-like member and that is provided to be integrated with one end of the drive shaft or that is coupled with the one end of the drive shaft;

a second member that is a plate-like or rod-like member and that is provided to be integrated with a leading end of the output shaft of the actuator or that is coupled with the leading end of the output shaft; and a fastening member configured to couple the first member with the second member in a detachable manner.

4. The apparatus for plating according to claim 3, wherein at least one of the first member and the second member has a crank, and the one end of the drive shaft and the leading end of the output shaft of the actuator are placed at different heights.

5. The apparatus for plating according to claim 3, wherein the fastening member is a bolt or a screw.

6. The apparatus for plating according to claim 1, wherein the output shaft of the actuator is placed parallel to the drive shaft of the drawer unit, and the drive shaft of the drawer unit is moved in an identical direction with the output shaft of the actuator.

7. The apparatus for plating according to claim 1, wherein the drawer unit comprises a bottom plate with the anode and the variable anode mask placed thereon, and a front plate forming part of a side wall of the plating tank.

8. The apparatus for plating according to claim 1, wherein the drawer unit comprises a bottom plate with the anode and the variable anode mask placed thereon, and a front plate forming part of a side wall of the plating tank, wherein the drive shaft is pierced through the front plate and is connected with the output shaft of the actuator, outside of the plating tank.

9. The apparatus for plating according to claim 8, wherein the drawer unit further comprises a bearing provided to pass through the front plate and configured to guide the driveshaft, and seals provided on respective ends of the bearing and configured to seal between the driveshaft and the bearing.

10. The apparatus for plating according to claim 8, wherein the drawer unit comprises a bus bar electrically connected with the anode to feed electric power to the anode, and the bus bar is pierced through the front plate and is extended to outside of the plating tank.

11. The apparatus for plating according to claim 8, wherein the bottom plate is provided with an opening for liquid drainage.

12. A method of manufacturing an apparatus for plating, the method comprising:

providing a plating tank;

inserting a drawer unit comprising at least a bottom plate configured to hold an anode and a variable anode mask, a front plate provided to form part of a side wall of the plating tank, and a drive shaft pierced through the front plate and configured to drive the variable anode mask, into the plating tank;

mounting an actuator to an outer face of the side wall of the plating tank at a location other than the front plate; and connecting the drive shaft of the drawer unit with an output shaft of the actuator in a detachable manner, outside of the plating tank.

13. The method according to claim 12, wherein the drawer unit further comprises a bus bar configured to feed electric power to the anode.

* * * * *